US008926066B2

(12) United States Patent
Sakurai et al.

(10) Patent No.: US 8,926,066 B2
(45) Date of Patent: Jan. 6, 2015

(54) LIQUID EJECTION HEAD

(75) Inventors: Masataka Sakurai, Kawasaki (JP); Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/123,947

(22) PCT Filed: May 28, 2012

(86) PCT No.: PCT/JP2012/003468

§ 371 (c)(1),
(2), (4) Date: Mar. 26, 2014

(87) PCT Pub. No.: WO2012/169139

PCT Pub. Date: Dec. 13, 2012

(65) Prior Publication Data

US 2014/0198158 A1 Jul. 17, 2014

(30) Foreign Application Priority Data

Jun. 7, 2011 (JP) ..... 2011-127253

(51) Int. Cl.
*B41J 2/14* (2006.01)
*B41J 2/15* (2006.01)

(52) U.S. Cl.
CPC ..... *B41J 2/14* (2013.01); *B41J 2/14072* (2013.01); *B41J 2/14145* (2013.01); *B41J 2002/14387* (2013.01); *B41J 2/1404* (2013.01); *B41J 2002/14467* (2013.01)
USPC ..... 347/50; 347/40; 347/48

(58) Field of Classification Search
CPC ..... B41J 2/1631; B41J 2/1628; B41J 2/1623; B41J 2/1635; B41J 2/1642; B41J 2/14427; B41J 2/1639; B41J 2002/14491; B41J 2/14072; B41J 2/14233
See application file for complete search history.

(56) References Cited

U.S. PATENT DOCUMENTS 8,523,325 B2 * 9/2013 Sakurai et al. ..... 347/50
2010/0201748 A1 8/2010 Kishikawa et al.

FOREIGN PATENT DOCUMENTS

JP H01-242262 A 9/1989
JP 2010-179608 A 8/2010
JP 2010-201926 A 9/2010
WO 2004/060682 A1 7/2004
WO 2010/090042 A1 8/2010

* cited by examiner

*Primary Examiner* — Lisa M Solomon
(74) *Attorney, Agent, or Firm* — Canon USA Inc IP Division

(57) ABSTRACT

A liquid ejection head includes
a substrate including
a first supply port row in which a plurality of supply ports are arranged,
a first energy generating element row in which a plurality of energy generating elements are arranged,
a second supply port row in which a plurality of supply ports are arranged,
a second energy generating element row in which a plurality of energy generating elements are arranged,
a first wiring layer and a second wiring layer for driving the energy generating elements, and
a through hole configured to electrically connect the first wiring layer and the second wiring layer.
The first energy generating element row, the first supply port row, the second supply port row, and the second energy generating element row are arranged in parallel in this order and the through hole is arranged between the first supply port row and the second supply port row.

12 Claims, 5 Drawing Sheets

LIQUID EJECTION HEAD

TECHNICAL FIELD

The present invention relates to a liquid ejection head that ejects liquid such as ink from ejection orifices.

BACKGROUND ART

FIG. 6 is an enlarged plan view of a surface of a substrate 102 of a liquid ejection head described in PTL 1. Although the surface of the substrate 102 of the liquid ejection head is covered by an orifice plate in which ejection orifices 107*a* and 107*b* are formed, in order to show positions of components of the substrate 102, the substrate 102 is shown passing through the orifice plate.

Rows of the ejection orifices 107*a* and 107*b* formed in the orifice plate are aligned in parallel with each other. The ejection orifices 107*a* and 107*b* are through-openings penetrating the orifice plate in the thickness direction of the substrate 102. In the substrate 102, three rows of supply ports 124*a*, 124*ab*, and 124*b* are formed so that each of the two rows of the ejection orifices 107*a* and 107*b* is sandwiched by two of the three rows of the supply ports 124*a*, 124*ab*, and 124*b*. The supply ports 124*a*, 124*ab*, and 124*b* penetrate the substrate plate in the thickness direction of the substrate 102 and are formed into substantially the same shape. Therefore, values of the flow resistance of the liquid in the supply ports 124*a*, 124*ab*, and 124*b* are substantially the same as each other.

Each of the two rows of the ejection orifices 107*a* and 107*b* are arranged at substantially the center between the rows of the supply ports adjacent to both sides of each row of the ejection orifices 107*a* and 107*b*. Values of the flow resistance of the liquid in flow passages from each supply port to each ejection orifice are also substantially the same as each other. Therefore, flows of the liquid flowing between the ejection orifices 107*a* and 107*b* and the supply ports 124*a*, 124*ab*, and 124*b* arranged to sandwich the ejection orifices 107*a* and 107*b* are substantially the same as each other.

Heaters 109*a* and 109*b* are provided at positions facing the ejection orifices 107*a* and 107*b* in the substrate 102. When the heaters 109*a* and 109*b* are driven, bubbles are generated in the liquid, so that the liquid is ejected from the ejection orifices.

Here, in the substrate 102, first areas where the row of the supply ports are provided are defined as areas alpha and second areas where the row of the heaters are provided are defined as areas beta. In this case, as shown in FIG. 6, the areas alpha and the areas beta are alternately arranged on the substrate 102.

In this liquid ejection head, the liquid supplied from the supply ports 124*a* and 124*ab* is supplied to near the ejection orifices 107*a*. The liquid supplied from the supply ports 124*ab* and 124*b* is supplied to near the ejection orifices 107*b*. The liquid supplied to near the ejection orifices 107*a* and 107*b* are ejected from the ejection orifices 107*a* and 107*b* to a recording medium by thermal energy generated by driving the heaters 109*a* and 109*b*.

It is necessary to provide wiring to drive the heaters 109*a* and 109*b* in the liquid ejection head shown in FIG. 6. The heaters 109*a* and 109*b* are provided on a surface (hereinafter referred to as the surface) of the substrate 102 facing the orifice plate, so that the wiring needs to be also provided on the surface of the substrate 102. Such a configuration makes the structure of the surface of the substrate 102 complex. In other words, a wiring arrangement area for the wiring needs to be secured, so that it results in higher cost due to increasing the size of the substrate.

In order to reduce the wiring arrangement area on the surface of the substrate 102, a part of the wiring to drive the heaters 109*a* and 109*b* can be multi-layered. In order to do so, it is necessary to form through holes for conducting between the multi-layered wirings in the substrate 102. PTL 1 discloses a liquid ejection head in which through holes are provided.

FIG. 7 is an enlarged plan view of the surface of the substrate 102 of the liquid ejection head, in which through holes are formed, as described in PTL 1.

In the liquid ejection head shown in FIG. 7, the areas alpha and the areas beta are alternately arranged in the substrate 102 in the same manner as in the liquid ejection head shown in FIG. 6, However, a plurality of through holes are provided in one of the areas alpha (the area alpha in the center of FIG. 7) in the substrate 102 of the liquid ejection head shown in FIG. 7. Specifically, four through holes 132 are provided between each supply port in the row of the supply ports 124*ab*.

In the liquid ejection head shown in FIG. 7, the through holes 132 are provided between each supply port 124*ab*, so that the supply port 124*ab* has a flattened opening shape smaller than that of the liquid ejection head shown in FIG. 6.

Therefore, the flow resistance of the liquid in the supply port 124*ab* is greater than that in the supply ports 124*a* and 124*b*. Therefore, the speed of refilling the supply ports 124*ab* with the liquid after the liquid is ejected (the refilling speed) is slow because the flow resistance of the liquid in the supply port 124*ab* increases.

When the driving frequency of the heaters 109*a* and 109*b* (corresponding to the ejection frequency of the ejection orifices) is increased, the refilling of the supply ports 124*ab* is not sufficiently performed. As a result, the liquid may not be sufficiently supplied to the ejection orifices 107*a* and 107*b*.

Even when the liquid is sufficiently supplied, the flow resistance of the liquid in the supply port 124*ab* is greater than that in the supply ports 124*a* and 124*b*, so that bubbles generated when the heaters are driven spread to the supply ports 124*a* and 124*b* rather than to the supply port 124*ab*. Therefore, the ejection is performed by biased bubbles. Based on this, the direction of the liquid ejected from the ejection orifices 107*a* and 107*b* may be unstable.

CITATION LIST

Patent Literature

PTL 1: Japanese Patent Laid-Open No. 2010-179608

SUMMARY OF INVENTION

A liquid ejection head includes a substrate including a first supply port row which supplies liquid and in which a plurality of supply ports made up of penetrated holes are arranged, a first energy generating element row in which a plurality of energy generating elements that generates energy used to eject liquid supplied from the first supply port row are arranged, a second supply port row which supplies liquid and in which a plurality of supply ports made up of penetrated holes are arranged, a second energy generating element row in which a plurality of energy generating elements that generates energy used to eject liquid supplied from the second supply port row are arranged, a first wiring layer configured to drive the energy generating elements, a second wiring layer configured to drive the energy generating elements, and a through hole configured to electrically connect the first wiring layer and the second wiring layer, wherein the first energy generating element row, the first supply port row, the second supply port row, and the second energy generating element row are arranged in parallel in this order and the through hole is arranged between the first supply port row and the second supply port row.

DESCRIPTION OF EMBODIMENTS

Embodiments of the present invention will be described with reference to the drawings.

First Embodiment

Figure 1A:
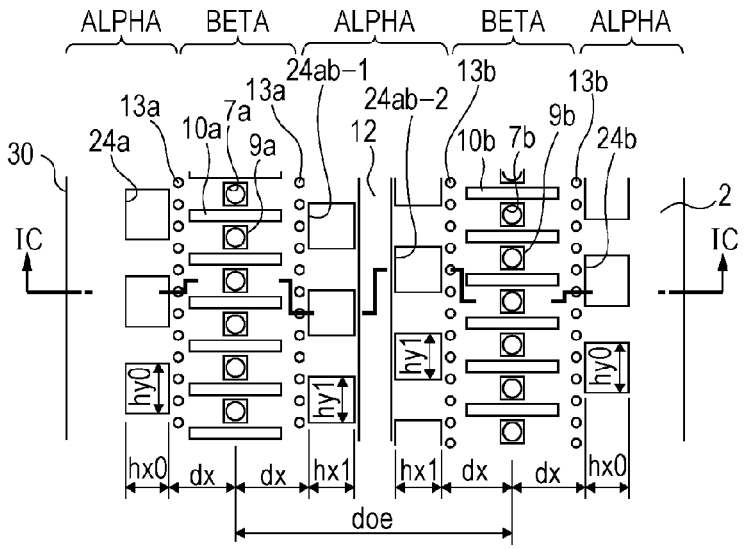
FIG. 1A is a schematic configuration diagram of a substrate of a liquid ejection head according to a first embodiment of the present invention.
Figure 1B:
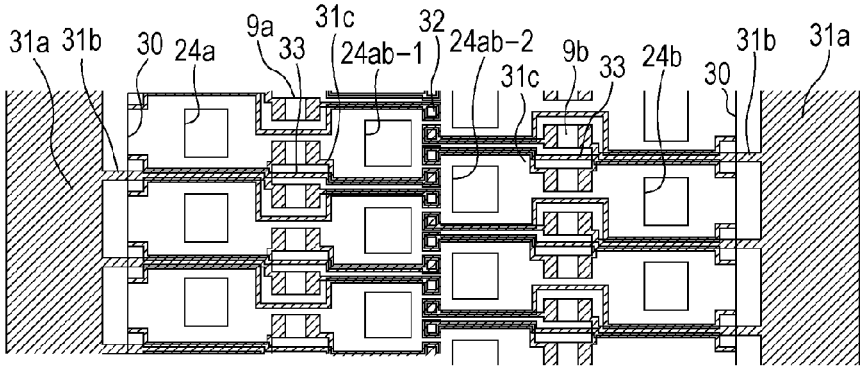
FIG. 1B is a schematic configuration diagram of the substrate of the liquid ejection head according to the first embodiment of the present invention.
Figure 1C:
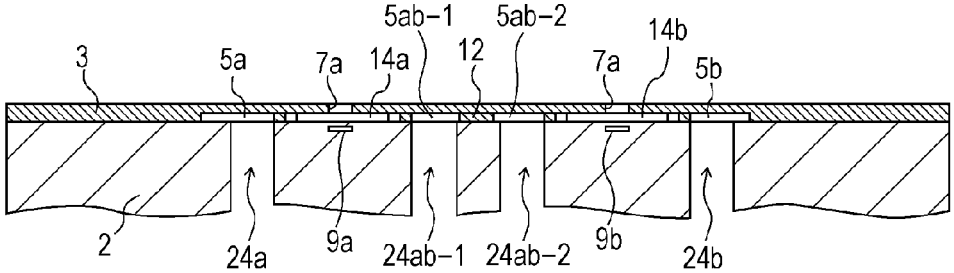
FIG. 1C is a schematic configuration diagram of the substrate of the liquid ejection head according to the first embodiment of the present invention.

FIGS. 1A, 1B, and 1C are enlarged schematic configuration diagrams of a part of a liquid ejection head according to a first embodiment of the present invention, in which FIGS. 1A and 1B are plan views and FIG. 1C is a cross-sectional view taken along the IC-IC line in FIG. 1A. Although, as shown in FIG. 1C, an orifice plate 3 in which ejection orifices 7*a* and 7*b* are formed is attached to a surface of a substrate 2 of the liquid ejection head, components of the substrate 2 are shown passing through the orifice plate 3 in FIGS. 1A and 1B.

As shown in FIG. 1A, in the liquid ejection head, the ejection orifices 7*a* and 7*b* formed in the orifice plate 3 are aligned in parallel with each other. As shown in FIG. 1C, the ejection orifices 107*a* and 107*b* are through-openings which penetrate the orifice plate in the thickness direction of the substrate 2 and have substantially the same diameter.

In the substrate 2, four rows of supply ports 24*a*, 24*ab*-1, 24*ab*-2, and 24*b* are formed along the rows of the ejection orifices 7*a* and 7*b*. As shown in FIG. 1C, the supply ports 24*a*, 24*ab*-1, 24*ab*-2, and 24*b* are through-openings penetrating the substrate 2.

As shown in FIG. 1C, heaters 9*a* and 9*b*, which are energy generating elements, are provided at positions facing the ejection orifices 7*a* and 7*b* in the substrate 2. A partition member 10*a* is provided between adjacent heaters in a row of heaters 9*a* and a partition member 10*b* is provided between adjacent heaters in a row of heaters 9*b*. The partition members 10*a* and 10*b* are formed integrally with the orifice plate 3 and adhered to the surface of the substrate 2.

A row of cylindrical filters 13*a* is provided between the row of the heaters 9*a* and the partition members 10*a* and the row of the supply ports 24*a* and between the row of the heaters 9*a* and the partition members 10*a* and the row of the supply ports 24*a*-1. A row of cylindrical filters 13*b* is provided between the row of the heaters 9*b* and the partition members 10*b* and the row of the supply ports 24*ab*-2 and between the row of the heaters 9*b* and the partition members 10*b* and the row of the supply ports 24*b*. The filters 13*a* and 13*b* are formed integrally with the orifice plate 3 and adhered to the surface of the substrate 2.

In the above configuration, a space between the ejection orifice 7*a* and heater 9*a* and a space between the ejection orifice 7*b* and heater 9*b* are pressure chambers 14*a* and 14*b* surrounded on all six sides by the orifice plate 3, the substrate 2, the partition members 10*a* or the partition members 10*b*, and the filters 13*a* or the filters 13*b* (see FIG. 1C).

Here, in the substrate 2, first areas where the row of the supply ports are provided are defined as areas alpha and second areas where the row of the heaters (which corresponds to the row of pressure chambers) are provided are defined as areas beta. In this case, as shown in FIG. 1A, the areas alpha and the areas beta are alternately arranged on the substrate 2.

In the area alpha in the center of the substrate 2, a partition member 12 is provided between the row of supply ports 24*b*-1 and the row of supply ports 24*b*-2. The partition member 12 is formed integrally with the orifice plate 3 and adhered to the surface of the substrate 2.

As shown in FIG. 1B, the area alpha in the center of the substrate 2 shown in FIG. 1A is a conducting section in which through holes 32 are arranged along the partition member 12 in the substrate 2. Top surfaces of the through holes 32 are covered by the partition member 12.

A common power supply wiring 31*a* is provided at both ends of the surface of the substrate 2 and a plurality of upper layer wirings 31*b* are drawn from the common power supply wiring 31*a*. Each upper layer wiring 31*b* passes between the supply ports 24*a* or 24*b* and connected to the heater 9*a* or 9*b*.

An upper layer wiring 31*c* is drawn from each of the heaters 9*a* and 9*b* and each upper layer wiring 31*c* passes between the supply ports 24*ab*-1 or 24*ab*-2 and connected to each through hole 32.

In each through hole 32, a conducting section is provided which penetrates an insulating interlayer film between an upper layer wiring 31 which is a first wiring layer and a lower layer wiring 33 which is a second wiring layer and electrically connects the upper layer wiring 31 and the lower layer wiring 33. Thereby, each through hole 32 electrically connects the upper layer wiring 31*c* and the lower layer wiring 33. Each lower layer wiring 33 passes between the supply ports 24 and connected to each drive circuit 30. The drive circuit 30 includes an array of drive transistors corresponding to each heater 9*a* or 9*b*. Control of the drive transistors is performed by a control circuit (not shown in the drawings).

In the above configuration, wirings for driving the heaters 9*a* and 9*b* can be provided in the first layer and the second layer of the substrate 2 by the through holes 32. Therefore, an area in which the wirings need to be arranged can be smaller than in a case where only one-layer wirings are provided.

Therefore, an area between each supply port of the rows of the supply ports 24*a*, 24*ab*-1, 24*ab*-2, and 24*b*, in which a wiring passes on the surface of the substrate, can be small. Therefore, it is possible to reduce the flow resistance of the liquid at each supply port by enlarging each supply port. The flow resistance of the liquid is reduced, so that the throughput of a recording device in which the liquid ejection head is mounted improves.

An insulating protective film covers immediately above the conducting section of the through hole 32 to prevent the liquid from coming into contact with the conducting section. Thereby, it is possible to prevent trouble in driving the heaters 9*a* and 9*b*.

Further, in the present embodiment, the partition member 12 covers an upper surface of the row of the though holes 32. Generally, to form the through hole 32, first, the first wiring layer and the insulating interlayer film are formed, and then a through-opening to be the though hole is formed. Thereafter, the second wiring layer is formed, so that only the through hole that penetrates the interlayer film becomes the conducting section. The through-opening is formed in the interlayer film between the first wiring layer and the second wiring layer, so that a steep stepped portion may be formed due to a stepped portion of the through-opening in the interlayer film on the surface of the substrate 2. An insulating film formed by a normal film forming method tends to be thin at the steep stepped portion, so that it may be desired that the steep stepped portion is not exposed to liquid such as ink for a long time from the viewpoint of reliability.

The partition member 12, which is an insulator, covers the upper surface of the row of the though holes 32, so that even when there are steep stepped portions around the through holes 32 on the surface of the substrate 2, it is possible to effectively prevent the liquid flowing through the supply ports 24*ab*-1 and 24*ab*-2 from coming into contact with the through holes 32.

In this way, in the liquid ejection head according to the present embodiment, the liquid is prevented from coming into contact with the conducting sections of the through holes 32, so that the reliability improves.

In the liquid ejection head according to the present embodiment, the liquid supplied from the supply ports 24*a* and 24*ab*-1 is supplied to near the ejection orifices 7*a*. The liquid supplied from the supply ports 24*ab*-2 and 24*b* is supplied to near the ejection orifices 7*b*. The liquid supplied to near the ejection orifices 7*a* and 7*b* are ejected from the ejection orifices 7*a* and 7*b* to a recording medium by thermal energy generated by driving the heaters 9*a* and 9*b*.

In the liquid ejection head, as shown in FIG. 1C, common liquid chambers 5*a*, 5*ab*-1, 5*ab*-2, and 5*b* are provided.

The liquid flowing from the supply ports 24*a* and 24*ab*-1 into the common liquid chambers 5*a* and 5*ab*-1 passes between the filters 13*a* shown in FIG. 1A and is supplied to the pressure chambers 14*a*. Therefore, if foreign substances such as dust are mixed in the liquid in the supply ports 24*a* and 24*ab*-1, the foreign substances are prevented from entering the pressure chambers 14*a* by the filters 13*a*.

The liquid flowing from the supply ports 24*ab*-2 and 24*b* into the common liquid chambers 5*ab*-2 and 5*b* passes between the filters 13*b* shown in FIG. 1A and is supplied to the pressure chambers 14*b*. Therefore, if foreign substances such as dust are mixed in the liquid in the supply ports 24*ab*-1 and 24*b*, the foreign substances are prevented from entering the pressure chambers 14*b* by the filters 13*b*.

In this way, in the liquid ejection head according to the present embodiment, it is difficult for foreign substances to enter the pressure chambers 14*a* and 14*b*. Therefore, in the liquid ejection head, it is possible to prevent trouble such as clogging in the ejection orifices.

In the present embodiment, as shown in FIG. 1A, distances dx from each supply port to an ejection orifice to which the liquid is supplied from the supply port are substantially the same as each other. In other words, the ejection orifices 7*a* and 7*b* are provided at the center of the pressure chambers 14*a* and 14*b* respectively. As shown in FIG. 1C, the common liquid chambers and the pressure chambers in which the liquid passes from the supply ports to the ejection orifices are formed to be substantially the same height, so that values of the flow resistance of the liquid in the common liquid chambers and the pressure chambers are substantially the same as each other.

Therefore, the flow of the liquid near the ejection orifices 7*a* and 7*b* depends on the flow resistance of the liquid in each supply port. Thus, if the values of the flow resistance of the liquid in each supply port are set to substantially the same as each other, the liquids supplied from each supply port converge near the ejection orifices 7*a* and 7*b* and the flow of the liquid is difficult to be biased near the ejection orifices 7*a* and 7*b*.

It is desired that the opening areas of the supply ports 24*a*, 24*ab*-1, 24*ab*-2, and 24*b* are substantially the same as each other in order to set the values of the flow resistance of the liquid in the supply ports 24*a*, 24*ab*-1, 24*ab*-2, and 24*b* to be substantially the same as each other. Here, as shown in FIG. 1A, when the lengths of two sides adjacent to each other of the supply ports 24*a* and 24*b* are hx0 and hy0 and the lengths of two sides adjacent to each other of the supply ports 24*ab*-1 and 24*ab*-2 are hx1 and hy1, it is desired that the following equation is established.

$$hx0*hy0=hx1*hy1$$

It is desired that the values of hx0 and hy0 are substantially the same as the values of hx1 and hy1 respectively. However, if the equation above is established, the values of hx0 and hy0 only have to be near the values of hx1 and hy1 respectively. If the values of the flow resistance of the liquid in the supply ports 24*a*, 24*ab*-1, 24*ab*-2, and 24*b* are substantially the same as each other, it is not necessary to satisfy the above equation.

As described above, the values of the flow resistance of the liquid in the supply ports 24*a*, 24*ab*-1, 24*ab*-2, and 24*b* are substantially the same as each other. Therefore, the liquids supplied from the supply ports 24*a*, 24*ab*-1, 24*ab*-2, and 24*b* converge near the ejection orifices 7*a* and 7*b*. Bubbles generated by the thermal energy generated by driving the heaters 9*a* and 9*b* grow and contract symmetrically.

The liquid is ejected from the ejection orifices 7*a* and 7*b* in a direction perpendicular to the surface of the orifice plate 3 by the bubbles symmetrically generated by the heaters 9*a* and 9*b*. Accordingly, the liquid is stably ejected from the ejection orifices 7*a* and 7*b*.

When the distance between the ejection orifices 7*a* and 7*b* is doe as shown in FIG. 1A, the distance doe is desired to be a distance of a multiple of a pixel resolution distance or a distance divisible by a number near a number obtained by dividing the pixel resolution distance by an integer. By the configuration as described above, in an image forming operation, it is possible to relatively easily perform ejection control of liquid into a pixel grid.

Figure 2A:
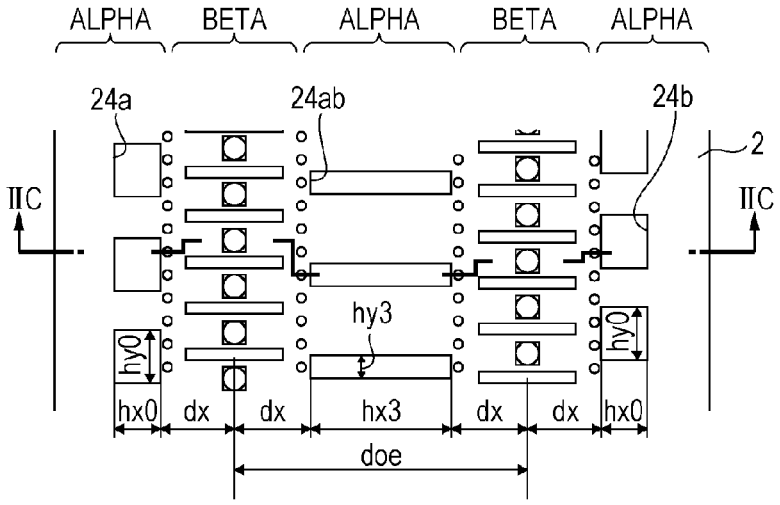
FIG. 2A is a schematic configuration diagram of a substrate of a liquid ejection head according to a comparative example.
Figure 2B:
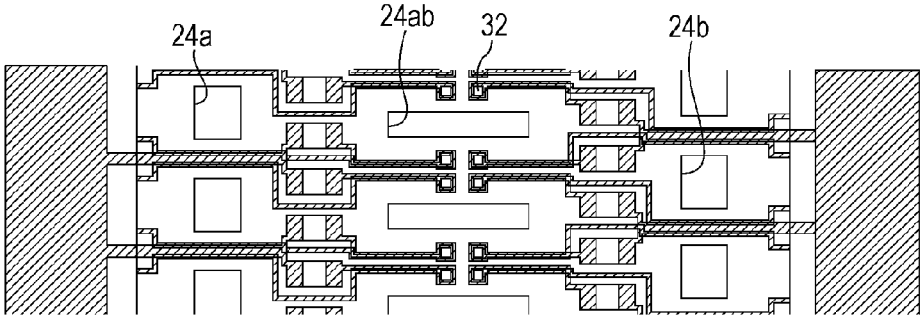
FIG. 2B is a schematic configuration diagram of the substrate of the liquid ejection head according to the comparative example.
Figure 2C:
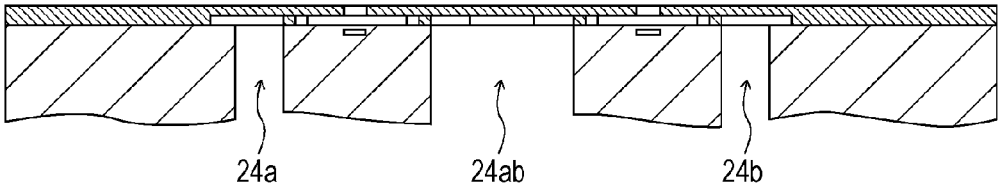
FIG. 2C is a schematic configuration diagram of the substrate of the liquid ejection head according to the comparative example.

FIGS. 2A, 2B, and 2C are enlarged schematic configuration diagrams of a part of a liquid ejection head according to a comparative example of the present embodiment, in which FIGS. 2A and 2B are plan views and FIG. 2C is a cross-sectional view taken along the IIC-IIC line in FIG. 2A.

Components of the liquid ejection head shown in FIGS. 2A, 2B, and 2C are the same as those of the liquid ejection head shown in FIGS. 1A, 1B, and 1C except for the area alpha in the center of the substrate 2, so that the descriptions of the same components will be omitted.

Although, in the liquid ejection head shown in FIG. 1, two rows of the supply ports are provided in the area alpha in the center of the substrate 2, in the liquid ejection head shown in FIG. 2, only one row of the supply ports are provided in the area alpha in the center of the substrate 2. As shown in FIG. 2B, four through holes 32 are provided between each supply port 24*ab*.

In this liquid ejection head, the opening areas of the supply ports 24*a*, 24*ab*, and 24*b* are substantially the same as each other. Here, as shown in FIG. 2A, when the lengths of two sides adjacent to each other of the supply ports 24*a* and 24*b* are hx0 and hy0 and the lengths of two sides adjacent to each other of the supply port 24*ab* are hx3 and hy3, the following equation is established.

$$hx0*hy0=hx3*hy3$$

As shown in FIG. 2B, in the liquid ejection head, four through holes 32 are provided between each supply port 24*ab*, so that the length hy3 of the supply port 24*ab* has to be shortened. Here, we try to set the flow resistance of the liquid in the supply port 24*ab* to be the same as that in the supply ports 24*a* and 24*b*. Then, the opening area of the supply port 24*ab* needs to be substantially the same as that of the supply ports 24*a* and 24*b*. To that end, the length hx3 has to be increased.

Therefore, the distance doe between the ejection orifices 7*a* and 7*b* increases. Thus, the size of the substrate 2 increases. Hence, it is found that the liquid ejection head shown in FIGS. 2A, 2B, and 2C becomes larger than the liquid ejection head shown in FIGS. 1A, 1B, and 1C.

In the liquid ejection head shown in FIG. 2, even when the opening area of the supply port 24*ab* is set to be the same as that of the supply ports 24*a* and 24*b*, the flow resistance of the liquid in the supply port 24*ab* becomes greater than that in the supply ports 24*a* and 24*b*. This is because of the flattened shape of the supply port 24*ab*.

Therefore, the throughput of the liquid ejection head shown in FIGS. 2A, 2B, and 2C does not improve as much as that of the liquid ejection head shown in FIGS. 1A, 1B, and 1C.

Although the liquid ejection head shown in FIGS. 1A, 1B, and 1C has two rows of ejection orifices, the number of the rows of ejection orifices is not limited to this.

Figure 3A:
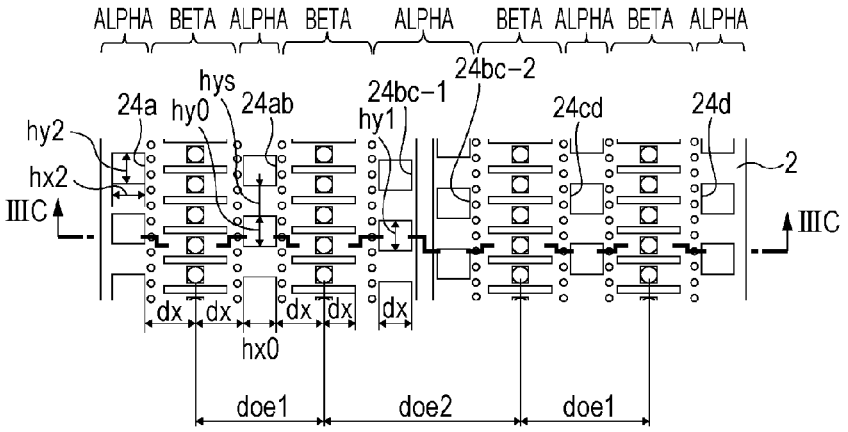
FIG. 3A is a schematic configuration diagram of a substrate of a liquid ejection head according to a modified example of the first embodiment of the present invention.
Figure 3B:
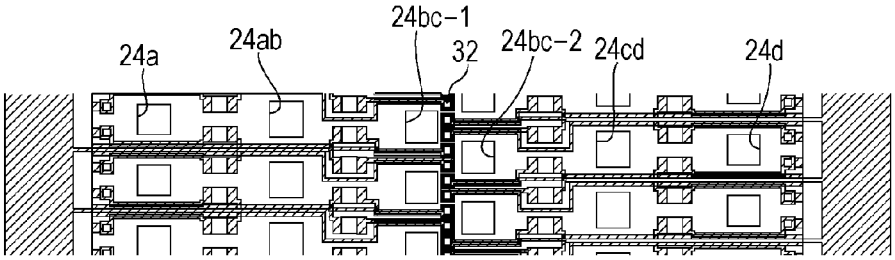
FIG. 3B is a schematic configuration diagram of the substrate of the liquid ejection head according to the modified example of the first embodiment of the present invention.
Figure 3C:
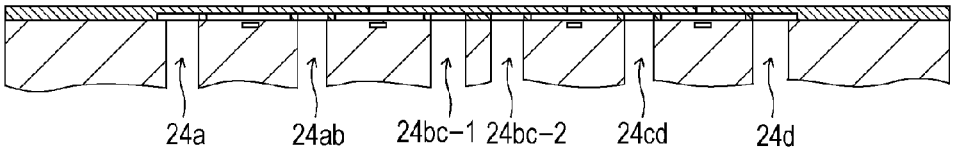
FIG. 3C is a schematic configuration diagram of the substrate of the liquid ejection head according to the modified example of the first embodiment of the present invention.

FIGS. 3A, 3B, and 3C are enlarged schematic configuration diagrams of a part of a liquid ejection head according to a modified example of the present embodiment, in which FIGS. 3A and 3B are plan views and FIG. 3C is a cross-sectional view taken along the IIIC-IIIC line in FIG. 3A.

Although the liquid ejection head shown in FIGS. 1A, 1B, and 1C is provided with two rows of ejection orifices, the liquid ejection head shown in FIGS. 3A, 3B, and 3C is provided with four rows of ejection orifices. On the other hand, in the same manner as in the liquid ejection head shown in FIGS. 1A, 1B, and 1C, two rows of ejection orifices are provided in the area alpha in the center of the substrate 2 in the liquid ejection head shown in FIGS. 3A, 3B, and 3C. As shown in FIG. 3B, the area alpha in the center of the substrate 2 shown in FIG. 3A is a conducting section in which through holes 32 are arranged along the partition member 12 in the substrate 2.

The throughput of the liquid ejection head having the configuration shown in FIGS. 3A, 3B, and 3C improves in the same manner as in the liquid ejection head shown in FIGS. 1A, 1B, and 1C.

The area alpha to be the conducting section need not be located in the center of the substrate 2. For example, the area alpha second from the left in FIG. 3A may be the conducting section.

The row of the through holes 32 in the area alpha to be the conducting section need not be aligned linearly. The configuration of the rows of the through holes 32 can be arbitrarily determined.

Figure 4A:
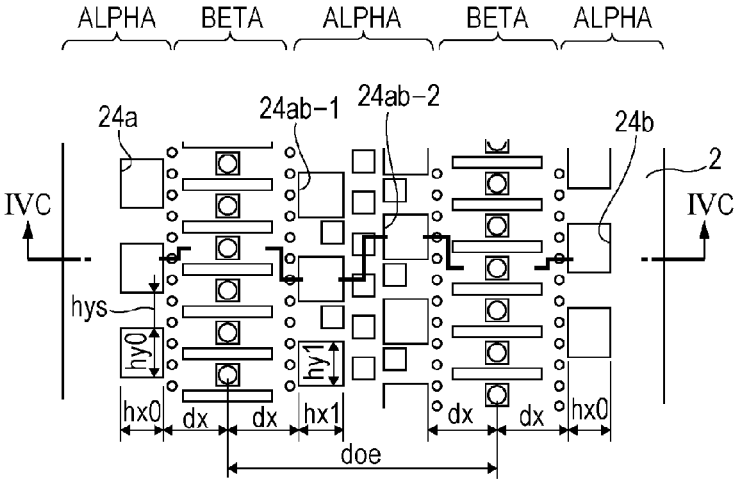
FIG. 4A is a schematic configuration diagram of a substrate of a liquid ejection head according to a modified example of the first embodiment of the present invention.
Figure 4B:
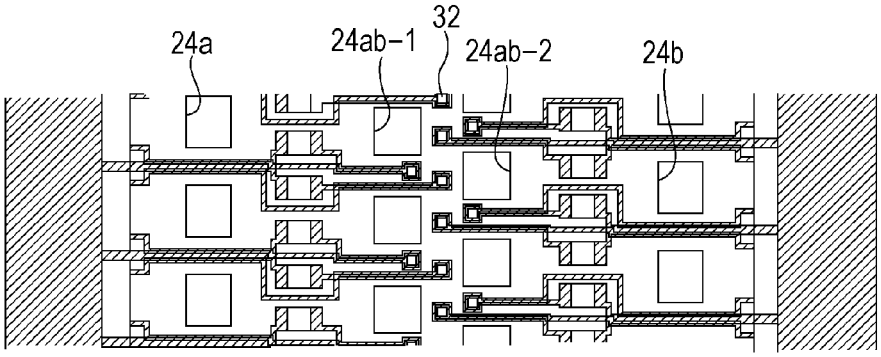
FIG. 4B is a schematic configuration diagram of the substrate of the liquid ejection head according to the modified example of the first embodiment of the present invention.
Figure 4C:
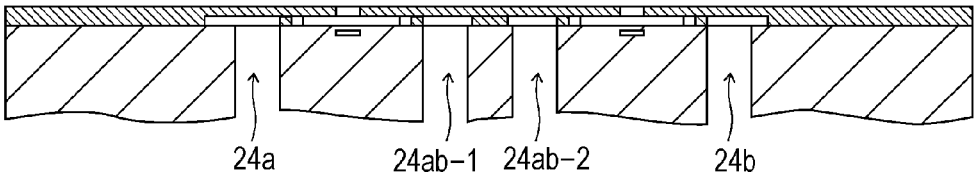
FIG. 4C is a schematic configuration diagram of the substrate of the liquid ejection head according to the modified example of the first embodiment of the present invention.

FIGS. 4A, 4B, and 4C are enlarged schematic configuration diagrams of a part of a liquid ejection head according to a modified example of the present embodiment, in which FIGS. 4A and 4B are plan views and FIG. 4C is a cross-sectional view taken along the IVC-IVC line in FIG. 4A.

As in the liquid ejection head shown in FIGS. 4A, 4B, and 4C, even if a part of the through holes 32 is disposed between supply ports in rows of the supply ports 24*ab*-1 and 24*ab*-2, the same effects as those of the liquid ejection head shown in FIGS. 1A, 1B, and 1C can be obtained.

Second Embodiment

Figure 5A:
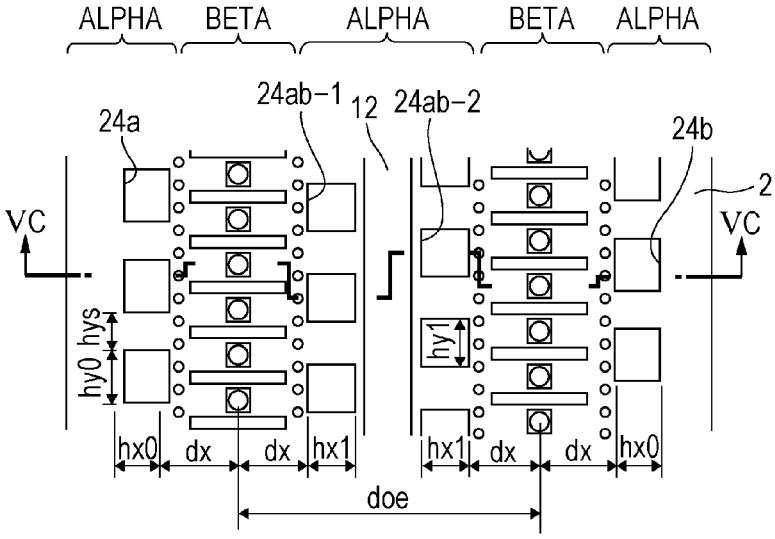
FIG. 5A is a schematic configuration diagram of a substrate of a liquid ejection head according to a second embodiment of the present invention.
Figure 5B:
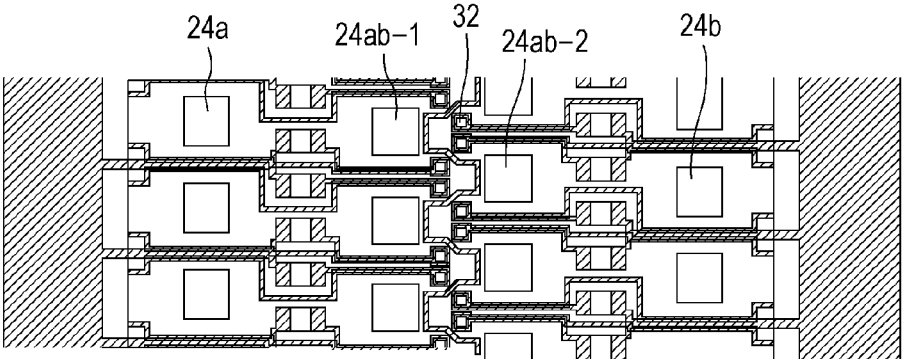
FIG. 5B is a schematic configuration diagram of the substrate of the liquid ejection head according to the second embodiment of the present invention.
Figure 5C:
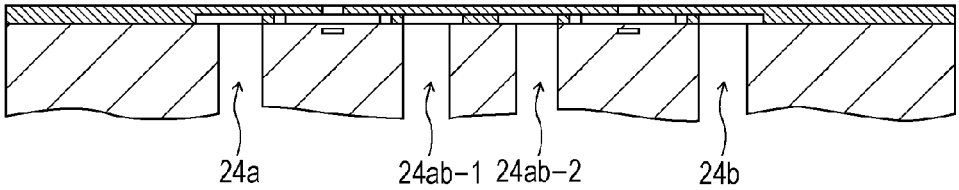
FIG. 5C is a schematic configuration diagram of the substrate of the liquid ejection head according to the second embodiment of the present invention.
Figure 6:
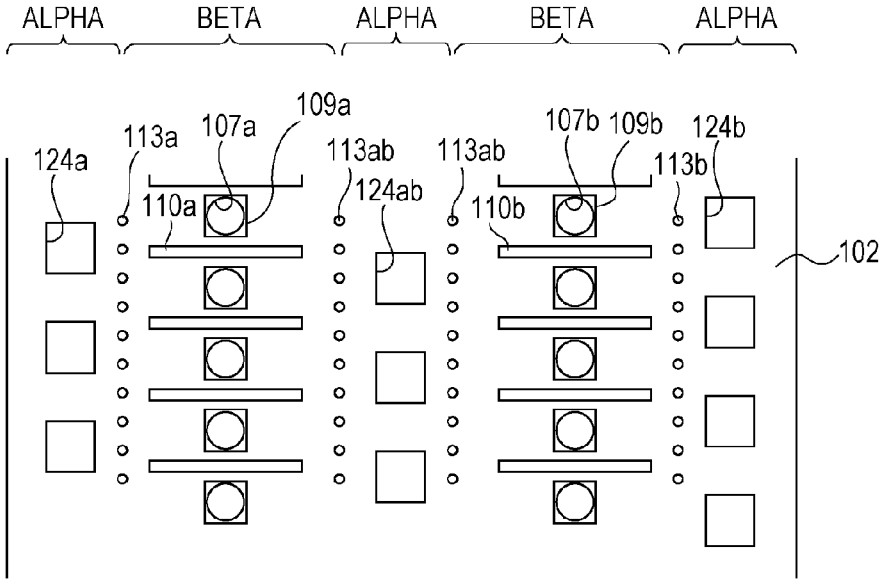
FIG. 6 is a schematic configuration diagram of a normal liquid ejection head.
Figure 7:
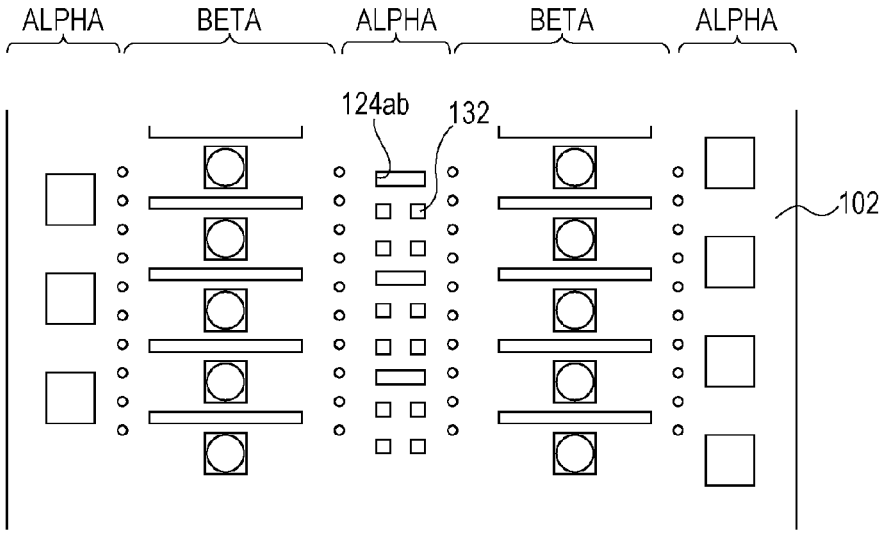
FIG. 7 is a schematic configuration diagram of a normal liquid ejection head.

FIGS. 5A, 5B, and 5C are enlarged schematic configuration diagrams of a part of a liquid ejection head according to a second embodiment of the present invention, in which FIGS. 5A and 5B are plan views and FIG. 5C is a cross-sectional view taken along the VC-VC line in FIG. 5A. In the liquid ejection head according to the present embodiment, components except for the components described below are the same as those of the liquid ejection head according to the first embodiment, so that the descriptions of the same components will be omitted.

The liquid ejection head according to the present embodiment is provided with sensor wiring 34. The sensor wiring 34 is formed so that the sensor wiring 34 threads between the through holes 32 and the supply ports 24*ab*-1 and 24*ab*-2. Therefore, the sensor wiring 34 is adjacent to all the supply ports 24*ab*-1 and 24*ab*-2. The sensor wiring 34 is covered by the partition member 12 and a slight voltage is applied to the sensor wiring 34.

When liquid comes into contact with the sensor wiring 34, a large current suddenly flows through the sensor wiring 34. Thereby, it is detected that the liquid comes into contact with the sensor wiring 34. For example, the sensor wiring 34 is useful in cases described below.

As a first example, the sensor wiring 34 can be used to inspect products when producing the liquid ejection heads.

When producing a liquid ejection head, if the positions of the supply ports 24*ab*-1 or 24*ab*-2 in the substrate 2 are shifted, the sensor wiring 34 is exposed to the supply ports 24*ab*-1 or 24*ab*-2 and comes into contact with the liquid.

In this way, when producing the liquid ejection heads, it is detected that the liquid comes into contact with the sensor wiring 24, so that it is possible to remove a liquid ejection head, in which the positions of the supply ports in the substrate 2 are shifted, as a defective product. Thereby the reliability of the liquid ejection head improves.

As a second example, the sensor wiring 34 can be used to detect erosion of the supply ports due to the flow of the liquid when a liquid ejection head determined not to be defective in the first example is used. If the supply ports are eroded by the liquid, the sensor wiring 34 is exposed to the supply ports 24*ab*-1 and 24*ab*-2 and comes into contact with the liquid.

In this way, it is possible to detect erosion of the supply ports caused by the use of the liquid ejection head. Thereby, it is possible to effectively prevent that the erosion of the supply ports advances and the liquid comes into contact with the heaters and the like. Thereby the reliability of the liquid ejection head improves.

If the area alpha is not provided, which is a conducting section in which rows of through holes 32 are provided as in the liquid ejection head according to the present embodiment, the sensor wiring is provided so that the sensor wiring threads between the supply ports and heaters on the surface of the substrate 2, so that the length of the sensor wiring becomes very long. Further, it is necessary to provide the sensor wiring in a position similar to a position of heater wiring, so that the configuration of the surface of the substrate 2 becomes complicated.

As described above, in the liquid ejection head according to the present embodiment, it is possible to improve reliability without complicating the configuration of the surface of the substrate 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-127253, filed Jun. 7, 2011, which is hereby incorporated by reference herein in its entirety.

The invention claimed is:

1. A liquid ejection head comprising:

a substrate including a first supply port row which supplies liquid and in which a plurality of supply ports made up of penetrated holes are arranged, a first energy generating element row in which a plurality of energy generating elements that generates energy used to eject liquid supplied from the first supply port row are arranged, a second supply port row which supplies liquid and in which a plurality of supply ports made up of penetrated holes are arranged, a second energy generating element row in which a plurality of energy generating elements that generates energy used to eject liquid supplied from the second supply port row are arranged, a first wiring layer configured to drive the energy generating elements, a second wiring layer configured to drive the energy generating elements, and a through hole configured to electrically connect the first wiring layer and the second wiring layer, wherein the first energy generating element row, the first supply port row, the second supply port row, and the second energy generating element row are arranged in parallel in this order and the through hole is arranged between the first supply port row and the second supply port row.

2. The liquid ejection head according to claim 1, wherein a third supply port row configured to supply liquid to the first energy generating element row is arranged on a side opposite to a side on which the first supply port row is arranged with respect to the first energy generating element row.

3. The liquid ejection head according to claim 1, wherein a fourth supply port row configured to supply liquid to the second energy generating element row is arranged on a side opposite to a side on which the second supply port row is arranged with respect to the second energy generating element row.

4. The liquid ejection head according to claim 1, wherein a plurality of the through holes are also formed between supply ports included in the first supply port row in addition to between the first supply port row and the second supply port row.

5. The liquid ejection head according to claim 1, wherein a plurality of the through holes are also formed between supply ports included in the second supply port row in addition to between the first supply port row and the second supply port row.

6. A liquid ejection head comprising:

a substrate in which a first area which penetrates the substrate in a thickness direction and where a row of supply ports is provided and a second area where a row of energy generating elements is provided are alternately arranged;

an orifice plate which is provided on a surface of the substrate on which the energy generating elements are formed and in which ejection orifices configured to eject liquid supplied from the supply ports are formed;

a plurality of through holes configured to electrically connect a first wiring layer and a second wiring layer provided in the substrate; and wherein at least one of a plurality of the first areas includes a conducting section provided with the plurality of through holes, two rows of the supply ports are provided in the conducting section, and the plurality of though holes are arranged between the two rows of the supply ports.

7. The liquid ejection head according to claim 6, wherein the plurality of though holes are arranged linearly.

8. The liquid ejection head according to claim 6, wherein three first areas and two second areas are included and, when the first areas and the second areas are alternately arranged, the first area located in the center is the conducting section.

9. The liquid ejection head according to claim 6, wherein five first areas and four second areas are included and, when the first areas and the second areas are alternately arranged, the first area located in the center is the conducting section.

10. The liquid ejection head according to claim 6, wherein the plurality of though holes are covered by an insulator.

11. The liquid ejection head according to claim 10, wherein the plurality of though holes are covered by a part of the orifice plate formed of an insulator.

12. The liquid ejection head according to claim 6, wherein sensor wiring adjacent to each supply port is provided in the conducting section.

* * * * *